US009210983B2

(12) United States Patent
Tran

(10) Patent No.: US 9,210,983 B2
(45) Date of Patent: Dec. 15, 2015

(54) TOOL FOR CREATING PAINT MARGINS ON FINGERNAILS

(76) Inventor: Christine Dung Tran, San Diego, CA (US)

( * ) Notice: Subject to any disclaimer, the term of this patent is extended or adjusted under 35 U.S.C. 154(b) by 0 days.

(21) Appl. No.: 11/767,499

(22) Filed: Jun. 23, 2007

(65) Prior Publication Data

US 2009/0120453 A1 May 14, 2009

(51) Int. Cl.
*A45D 29/00* (2006.01)

(52) U.S. Cl.
CPC ..... *A45D 29/004* (2013.01)

(58) Field of Classification Search
CPC ..... A45D 29/00
USPC ..... 132/73, 73.5, 200, 285, 319; D28/56, D28/61
See application file for complete search history.

(56) References Cited

U.S. PATENT DOCUMENTS

| | | | | | |
|---|---|---|---|---|---|
| 1,589,339 | A * | 6/1926 | Goldman | ..... | 132/75.3 |
| 2,300,170 | A * | 10/1942 | Pickard | ..... | 434/100 |
| D299,878 | S * | 2/1989 | Wienslaw | ..... | D28/99 |
| D309,196 | S * | 7/1990 | LaJoie | ..... | D28/56 |
| 5,755,239 | A * | 5/1998 | Baltierra | ..... | 132/73 |
| D396,130 | S * | 7/1998 | Shilinsky et al. | ..... | D28/56 |
| 5,778,903 | A * | 7/1998 | Tran et al. | ..... | 132/200 |
| 6,357,451 | B1 * | 3/2002 | Carter | ..... | 132/200 |
| 2003/0089378 | A1 * | 5/2003 | Chu | ..... | 132/200 |
| 2008/0092914 | A1 * | 4/2008 | Baxter | ..... | 132/200 |

* cited by examiner

*Primary Examiner* — Robyn Doan

(74) *Attorney, Agent, or Firm* — Thomas J. Tighe, Esq.

(57) ABSTRACT

A central body, preferably circular or rotund, has a plurality of elongated arms radiating out from it. Each arm includes a rigid blade end that defines a profile that operationally fits over a fingernail at an angle of incidence for masking an area of the fingernail during painting, or for scoring semi-hardened paint and scraping off excess paint. Angle of incidence is preferably acute, obtuse or right. Each blade end preferably operationally fits over a uniquely corresponding relatively small range of fingernail sizes. The end blades are disposed in order in a direction around the body, the order being progressively larger range sizes. A mark on each end blade is used for aligning the end blade with a longitudinal axis of a fingernail.

15 Claims, 2 Drawing Sheets

TOOL FOR CREATING PAINT MARGINS ON FINGERNAILS

BACKGROUND OF THE INVENTION

This invention relates in general to the art of fingernail painting, and in particular to a tool useful for creating a sharply defined paint margin on a fingernail. As used herein the term "fingernail painting" means applying to the exterior surface of a fingernail a substance used as a coating to protect and/or decorate the surface—especially a mixture of pigment suspended in a liquid that dries to form a hard coating, e.g. acrylic fingernail paints, and the term "paint" used as a noun refers to the aforesaid applied substance.

This invention is especially advantageous in creating a French look on a fingernail. "French look" commonly refers to a distinct band of color painted over an area extending from the distal end of a fingernail to a line intermediate the distal end and the eponychium or cuticle at the proximal end of the nail. "Distal" and "proximal" as used herein are referenced to a corresponding hand from which a subject finger extends. The proximal margin of a "French look" is most commonly curved convexly toward its fingernail tip, such as illustrated in FIG. 6 herein, and it is greatly preferred that the curvature of the proximal margin be sharply defined and smoothly curved. This invention provides a tool for sharply defining and smoothly curving the proximal margin of a French look. In creating a French look this invention can be used as a scraper or as a mask, and is adapted to be used on a wide range of fingernail sizes.

It should be noted that this invention can be very useful in creating margins other that those of a French look.

Other advantages and attributes of this invention will be readily discernable upon a reading of the text hereinafter.

SUMMARY OF THE INVENTION

A generalized object of this invention is to provide a tool especially useful in creating a sharply defined paint margin on a fingernail, and such a tool that is useful over a wide range of fingernail sizes. It should be understood that there are other objects not listed that the inventor considers significant or equally or more significant than the object stated in this paragraph.

These objects, and other objects expressed or implied in this document, are accomplished by a device for creating a sharply defined paint margin on a fingernail including a central body; a plurality of elongated arms radiating out from the central body; each arm including a rigid blade end remote from the body; and each blade end defining a profile that operationally fits over the fingernail at an angle of incidence for masking an area of the fingernail during painting, or for scoring semi-hardened paint and scraping off excess paint. each blade end operationally fits over a uniquely corresponding range of fingernail sizes. The end blades are preferably disposed in order in a direction around the body, the order being progressively larger range sizes. A mark on each end blade is used for aligning said each end blade with the longitudinal axis of a fingernail. The end blade profile can be symmetrical with respect to a long axis of a fingernail or asymmetrical.

DESCRIPTION OF THE PREFERRED EMBODIMENT

Figure 1:
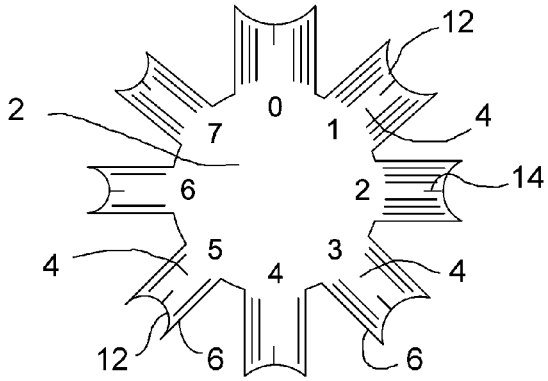
FIG. 1 is a plan view of a first embodiment of this invention.
Figure 2:
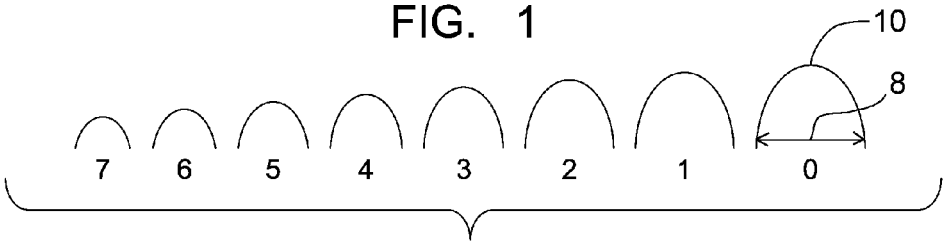
FIG. 2 are end views of the arms of the invention illustrated in FIG. 1.

Referring to FIGS. 1 and 2, this invention is illustrated to include a central body 2 that is preferably, but not necessarily, circular or otherwise rotund with a plurality of elongated arms 4 radiating from the body. Each arm has a rigid blade end 6 remote from the body. Each blade end defines a corresponding maximum width 8 and a lateral curvature 10 as best shown in FIG. 2, and further defines a longitudinal curvature 12 as best shown in FIG. 1. The combined curvatures and widths of each blade end define the blade end's profile. Likewise fingernails each have a profile defined by its lateral dimension and general curvature. Each blade end has a profile that fits over a uniquely corresponding small range of fingernail sizes. The term "fit" as used herein means that a particular blade end has a profile that closely fits over a small range of fingernail profiles such that the blade end can be successfully used, as further described below, to score and scrape off excess paint in order create a sharply defined and smoothly curving paint margin, and/or to mask a portion of a fingernail within the range during painting to create a sharply defined and smoothly curving margin. FIGS. 1 and 2 also illustrate that preferably the arms 4 are numbered (in this case 0-7) and are disposed around the body in progressive order of size, the number 0 arm being the largest and the number 7 arm being the smallest. It should be understood that in an alternative preferred embodiment, there are nine arms (0-8) that are also progressively disposed around a circular or otherwise rotund body.

Referring to FIG. 1, each blade end 6 includes a visible mark 14 at the blades longitudinal axis to facilitate centering the blade laterally over a fingernail. In operation, a user aligns the mark with a longitudinal axis of the fingernail.

Figure 3:
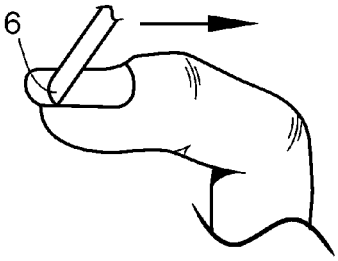
FIGS. 3-5 are pictorial views of embodiments of this invention in use.
Figure 4:
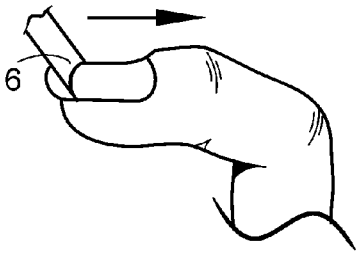
Figure 5:
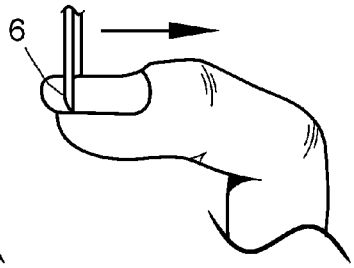
Figure 6:
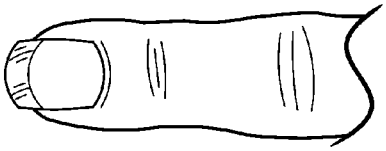
FIG. 6 is a pictorial view of a fingernail having a typical French look.

Referring to FIGS. 3-5, three operations of three embodiments of this invention are illustrated. This invention can be used to great advantage when applying acrylic paint. Conventionally, acrylic paint is prepared by mixing a powder with a liquid. The resulting acrylic mixture is applied as a uniform coating to a fingernail. In generally less than a minute the coating becomes semi-hardened but still plastic enough to cut and scrape off. As previously explained, a blade end 6 of this invention can be used to score the semi-hardened coating and scrape the coating off desired areas of the fingernail while leaving other areas coated, such as to form a French look, or the invention can be used to mask an area of the fingernail while the coating is being applied. The figures illustrate operational placement of the blade ends 6 over their respective fingernails for both, but the arrows pertain only to scraping operations. As to masking, as shown the blade ends mask a distal area of their respective fingernails from the rest of the fingernails, and since the blade ends fit over their respective fingernails from side to side, paint applied on one side of a blade end will not bleed over to the other side of the blade end. As to scoring and scraping, the paint can be first applied imprecisely over an area of the fingernail, such as a distal area. Then using the guide mark 12 to symmetrically fit the blade end over the fingernail at a selected location of a paint margin, a user presses the blade edge against the fingernail to score the semi-hardened coating, and then uses to blade end to scrape off excess coating, as shown by the arrows, thereby leaving a sharply defined paint margin along the score line. Alternatively, a blade end can be first used to mask an area during painting, and if any paint bleeds-through under the mask, the blade end can then be used to scrape off the bled-through paint.

Referring again to FIGS. 3-5, in order to have a close fit between an end blade and a fingernail the intended operational angle of incidence between the blade end and a fingernail determines to some extent the lateral and longitudinal curvatures of the end blade. FIG. 3 illustrates an embodiment that has an end blade profile best suited for operations in which the angle of incidence between the blade end and a fingernail is acute, preferably generally forty-five degrees. FIG. 4 illustrates an embodiment that has an end blade profile best suited for operations in which the angle of incidence between the blade end and a fingernail is obtuse, preferably generally one hundred and thirty-five degrees. FIG. 5 illustrates an embodiment that has an end blade profile best suited for operations in which the angle of incidence between the blade end and a fingernail is substantially a right angle, "substantially" meaning a range consisting of a right angle plus or minus some number of degrees within which the blade end can be effective to mask and/or score and scrape as described above.

Figure 7A:
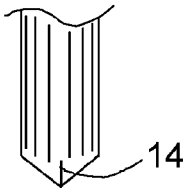
FIGS. 7A and 7B are plan and side views, respectively, of an end blade that can be used to create an angular paint margin.
Figure 7B:
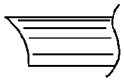
Figure 8A:
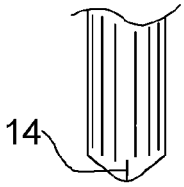
FIGS. 8A and 8B are plan and side views, respectively, of an end blade that can be used to create a rounded apex paint margin.
Figure 8B:
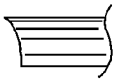
Figure 9B:
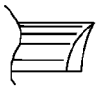
FIGS. 9A and 9B are plan and side views, respectively, of an end blade that can be used to create an asymmetric curved paint margin.
Figure 9A:
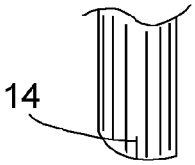

Referring to FIGS. 7A-9B, various alternative end blade profiles are illustrated by respective plan and side views. FIGS. 7A and 7B illustrate a profile that can be used to create a triangular paint margin. FIGS. 8A and 8B illustrate a profile that can be used to create a triangular margin having a rounded apex. FIGS. 9A and 9B illustrate a profile that can be used to create an asymmetrical paint margin. It should be noted that many other alternative margins can be created by selecting corresponding end blade profiles.

Figure 10:
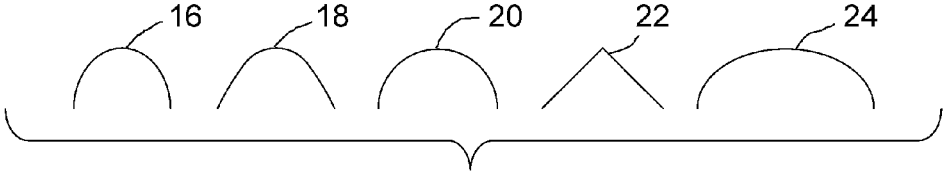
FIG. 10 is an exemplary set of paint margins that can be produced by means of this invention.

Referring to FIG. 10, illustrated are more edge views of end blade profiles according to this invention. These include a first ovular profile 16, a rounded apex profile 18, a second, wider ovular profile 20, a angular profile 22, and a third, even wider ovular profile 24.

Figure 11:
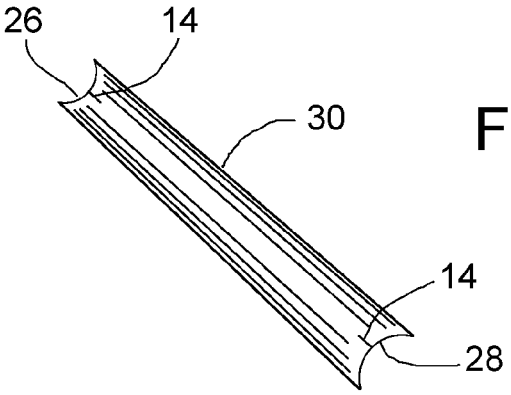
FIG. 11 is a top plan view of an alternative embodiment of this invention.

Referring to FIG. 11, an alternative embodiment of this invention is illustrated to include two end blades, 26 and 28, at opposite ends of an elongated midsection 30. In this embodiment each of the opposing end blades has a profile that allows said each to operationally fit over a range of fingernail sizes at an angle of incidence for masking an area of the fingernail during painting, or for scoring semi-hardened paint and scraping off excess paint, the ranges of the end blades differing form one another.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. A method of applying a decorative acrylic layer to a fingernail comprising:

(a) obtaining a volume of unhardened acrylic, (b) applying the unhardened acrylic to a distal portion of the fingernail, (c) after the acrylic has become semi-hardened, scoring the semi-hardened acrylic and scraping off excess acrylic using a rigid blade that defines a profile that allows the rigid blade to operationally fit over the fingernail at an angle of incidence therewith, the rigid blade being a remote end of one of a plurality of elongated, spaced arms radiating out from a central body, each arm including a rigid blade end remote from the body, the rigid blade ends defining respective profiles that allow said rigid blade ends to operationally fit over respective fingernail sizes at an acute angle of incidence therewith.

2. The method according to claim 1 wherein the angle of incidence is an acute angle.

3. The method according to claim 1 wherein the angle of incidence is an obtuse angle.

4. The method according to claim 1 wherein the angle of incidence is substantially a right angle.

5. The method according to claim 1 wherein each end blade further comprises a centered mark on for use in aligning said each end blade with the longitudinal axis of a fingernail.

6. The method according to claim 1 wherein the end blades are disposed in order in a direction around the body, the order being progressively larger range sizes.

7. The method according to claim 1 including a blade end profile that is symmetrical with respect to a long axis of a fingernail.

8. The method according to claim 1 including a blade end profile that is asymmetrical with respect to a long axis of a fingernail.

9. A device for creating a sharply defined acrylic margin on a fingernail comprising:

(a) a central body;

(b) a plurality of spaced elongated arms radiating out from the central body;

(c) each arm including a rigid blade end remote from the body;

(d) each blade end defining a respective profile that allows the blade end to operationally fit over a respective fingernail size at an angle of incidence for masking an area of a fingernail during application of the acrylic, or for scoring semi-hardened acrylic and scraping off excess acrylic; and (e) a centered mark on each blade end for use in aligning said each blade end with the longitudinal axis of a fingernail.

10. The device according to claim 9 including a blade end defining a profile that is asymmetrical with respect to a long axis of a fingernail when said blade end's centered mark is aligned with the long axis of a fingernail.

11. The device according to claim 9 wherein the angle of incidence is substantially a right angle.

12. A device for creating a sharply defined acrylic margin on a fingernail comprising:

(a) a central body;

(b) a plurality of spaced elongated arms radiating out from the central body;

(c) each arm including a rigid blade end remote from the body;

(d) each blade end defining a respective profile that allows the blade end to operationally fit over a respective fingernail size at an angle of incidence for masking an area of a fingernail during application of the acrylic, or for scoring semi-hardened acrylic and scraping off excess acrylic; and (e) wherein the angle of incidence is an acute angle.

13. The device according to claim 12 wherein the acute angle is substantially forty-five degrees.

14. A device for creating a sharply defined acrylic margin on a fingernail comprising:

(a) a central body;

(b) a plurality of spaced elongated arms radiating out from the central body;

(c) each arm including a rigid blade end remote from the body;

(d) each blade end defining a respective profile that allows the blade end to operationally fit over a respective fingernail size at an angle of incidence for masking an area of a fingernail during application of the acrylic, or for scoring semi-hardened acrylic and scraping off excess acrylic; and (e) wherein the angle of incidence is an obtuse angle.

15. The device according to claim 14 wherein the obtuse angle is substantially one hundred and thirty-five degrees.

* * * * *